US009709910B2

(12) United States Patent
Sakamoto

(10) Patent No.: US 9,709,910 B2
(45) Date of Patent: Jul. 18, 2017

(54) ELECTROSTATIC LATENT IMAGE DEVELOPING TONER

(71) Applicant: KYOCERA Document Solutions Inc., Osaka (JP)

(72) Inventor: Noriaki Sakamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/133,016

(22) Filed: Apr. 19, 2016

(65) Prior Publication Data

US 2016/0313659 A1 Oct. 27, 2016

(30) Foreign Application Priority Data

Apr. 24, 2015 (JP) ..... 2015-089309

(51) Int. Cl.
*G03G 9/08* (2006.01)
*G03G 9/093* (2006.01)
*G03G 9/097* (2006.01)

(52) U.S. Cl.
CPC ..... *G03G 9/0827* (2013.01); *G03G 9/0825* (2013.01); *G03G 9/093* (2013.01); *G03G 9/09708* (2013.01)

(58) Field of Classification Search
CPC . G03G 9/0825; G03G 9/0827; G03G 9/09708
USPC ..... 430/110.1, 110.3
See application file for complete search history.

(56) References Cited

U.S. PATENT DOCUMENTS

2008/0227015 A1 9/2008 Nagatomo et al.
2014/0349229 A1* 11/2014 Morales-Tirado ... G03G 9/0825 430/108.6

FOREIGN PATENT DOCUMENTS

JP 2008-233256 A 10/2008

* cited by examiner

*Primary Examiner* — Mark A Chapman
(74) *Attorney, Agent, or Firm* — Studebaker & Brackett PC

(57) ABSTRACT

An electrostatic latent image developing toner includes a plurality of toner particles. The toner particles each have a toner mother particle and first inorganic oxide particles disposed on a surface of the toner mother particle. The first inorganic oxide particles are contained in the electrostatic latent image developing toner in an amount of no less than 1.0% by mass and no greater than 2.0% by mass relative to mass of the toner mother particles. The toner mother particles have an average roundness of no less than 0.960. The first inorganic oxide particles have an average major axis diameter of no less than 500 nm and no greater than 3,000 nm, an average minor axis diameter of no less than 100 nm and no greater than 250 nm, and an aspect ratio of no less than 2 and no greater than 20.

7 Claims, 6 Drawing Sheets

ELECTROSTATIC LATENT IMAGE DEVELOPING TONER

INCORPORATION BY REFERENCE

The present application claims priority under 35 U.S.C. §119 to Japanese Patent Application No. 2015-089309, filed on Apr. 24, 2015. The contents of this application are incorporated herein by reference in their entirety.

BACKGROUND

The present disclosure relates to an electrostatic latent image developing toner (hereinafter, may be referred to as "a toner").

The use of a toner including toner particles with high roundness in an image forming apparatus has increased in recent years. Increasing roundness of toner particles facilitates formation of uniform toner particles. The use of a toner including uniform toner particles tends to facilitate stable formation of high-quality images. However, toner particles with high roundness easily pass under a cleaning section such as a cleaning blade in an image forming apparatus during image formation. Toner particles that have passed under the cleaning section and stay on a photosensitive member may cause an image defect in a resultant image. Various measures have been proposed in order to restrict occurrence of an image defect resulting from such insufficient cleaning.

A toner includes at least one external additive having, for example, an average primary particle size of no less than 80 nm and no greater than 180 nm and an aspect ratio of no less than 0.7 and no greater than 0.95.

SUMMARY

An electrostatic latent image developing toner according to an aspect of the present disclosure includes a plurality of toner particles. The toner particles each have a toner mother particle and first inorganic oxide particles disposed on a surface of the toner mother particle. The first inorganic oxide particles are contained in the electrostatic latent image developing toner in an amount of no less than 1.0% by mass and no greater than 2.0% by mass relative to mass of the toner mother particles. The toner mother particles have an average roundness of no less than 0.960. The first inorganic oxide particles have an average major axis diameter of no less than 500 nm and no greater than 3,000 nm, an average minor axis diameter of no less than 100 nm and no greater than 250 nm, and an aspect ratio of no less than 2 and no greater than 20.

DETAILED DESCRIPTION

The following describes an embodiment of the present disclosure. However, the present disclosure is not in any way limited by the following embodiment. Appropriate changes may be made when practicing the present disclosure so long as such changes do not deviate from the intended scope of the present disclosure. Note that description is omitted where appropriate in order to avoid repetition but such omission does not limit the essence of the present disclosure.

The term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof.

An average value used herein refers to an arithmetic mean value unless otherwise stated. When evaluation values (for example, values indicating shapes or properties) pertaining to powders (for example, toner particles, toner mother particles, first inorganic oxide particles, second inorganic oxide particles, toner cores, external additives, and toner to be described later) are given, such evaluation values are also arithmetic mean values unless otherwise stated. An arithmetic mean value is obtained by adding up values measured with respect to an appropriate number of measurement targets and dividing the sum by the number. The particle size of a powder is the diameter of a representative circle of a particle unless otherwise stated. The diameter of a representative circle is the diameter of a circle having the same area as a projection of the particle.

Figure 1A:
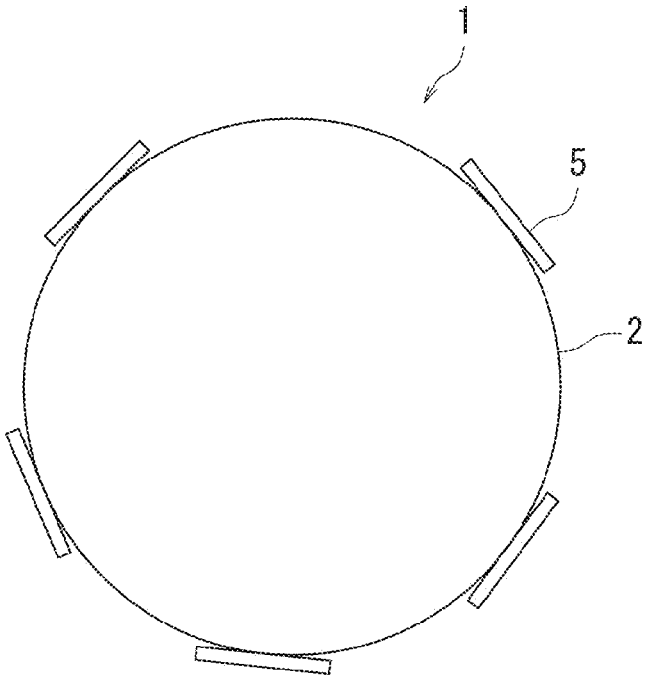
FIGS. 1A and 1B are cross-sectional views each illustrating an example of structure of a toner particle included in a toner according to an embodiment of the present disclosure.
Figure 1B:
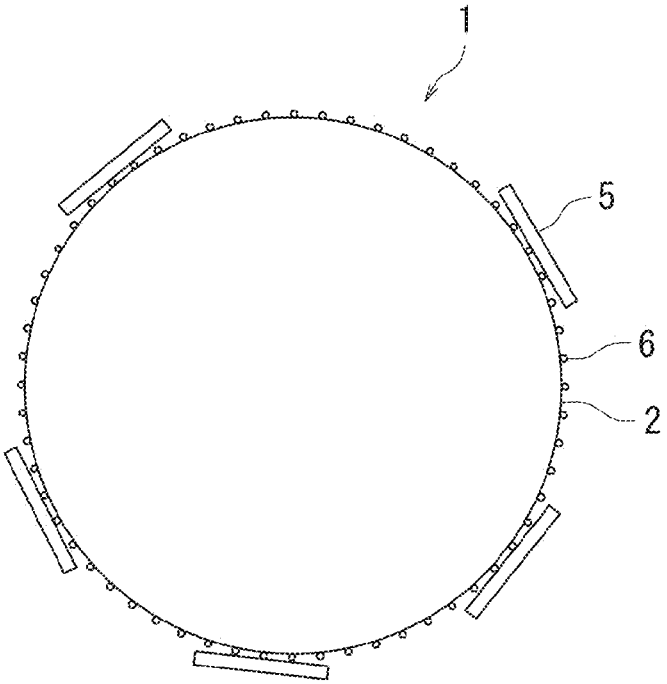
Figure 2A:
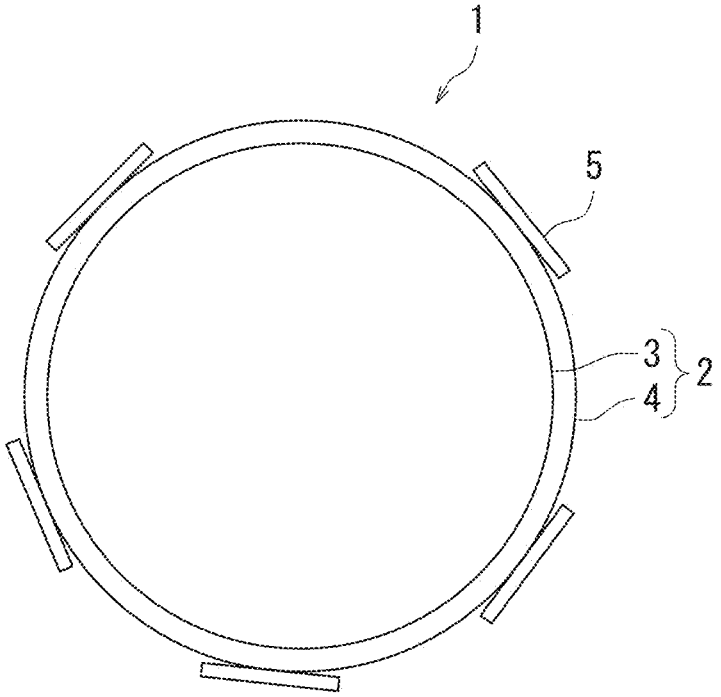
FIGS. 2A and 2B are cross-sectional views each illustrating another example of structure of the toner particle included in the toner according to the embodiment of the present disclosure.
Figure 2B:
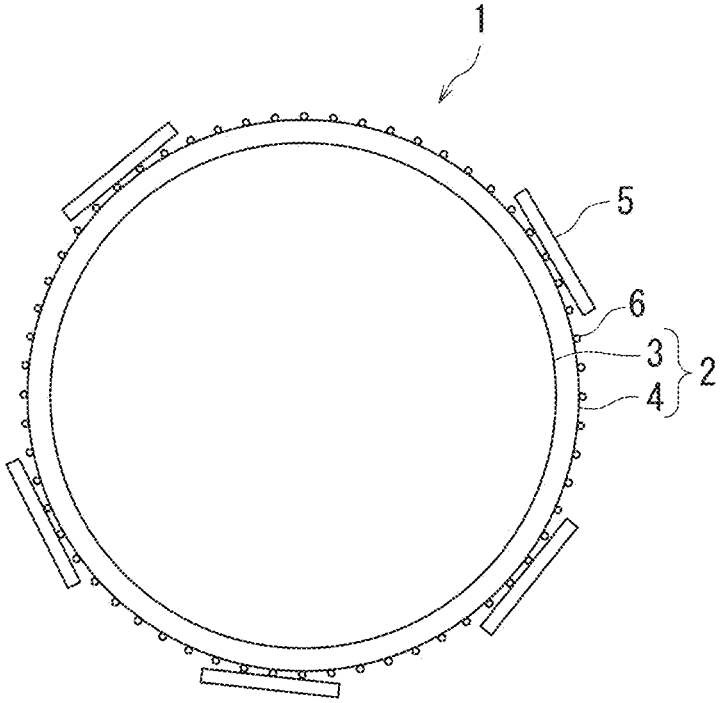

The embodiment of the present disclosure relates to a toner. The following describes a toner according to the present embodiment with reference to FIGS. 1A to 2B. FIGS. 1A and 1B are cross-sectional views each illustrating an example of structure of a toner particle 1 included in the toner. FIGS. 2A and 2B are cross-sectional views each illustrating another example of structure of the toner particle 1 included in the toner.

The toner includes a plurality of the toner particles 1. The toner may be a capsule toner. Alternatively, the toner may be a non-capsule toner with no shell layer 4. Alternatively, the toner may be a mixture of a capsule toner and a non-capsule toner.

In the case of the non-capsule toner, each toner particle 1 has a toner mother particle 2 and first inorganic oxide particles 5 as illustrated in FIG. 1A. The toner particle 1 may further has second inorganic oxide particles 6 as illustrated in FIG. 1B.

In the case of the capsule toner, each toner particle 1 has the toner mother particle 2 and the first inorganic oxide particles 5 as illustrated in FIG. 2A. The toner mother particle 2 has a toner core 3 and the shell layer 4. The shell layer 4 covers the toner core 3. The shell layer 4 is disposed so as to cover the toner core 3 (i.e., disposed over the toner core 3). Preferably, the shell layer 4 directly covers the toner core 3. The toner particle 1 may further has the second inorganic oxide particles 6 as illustrated in FIG. 2B.

Figure 3:
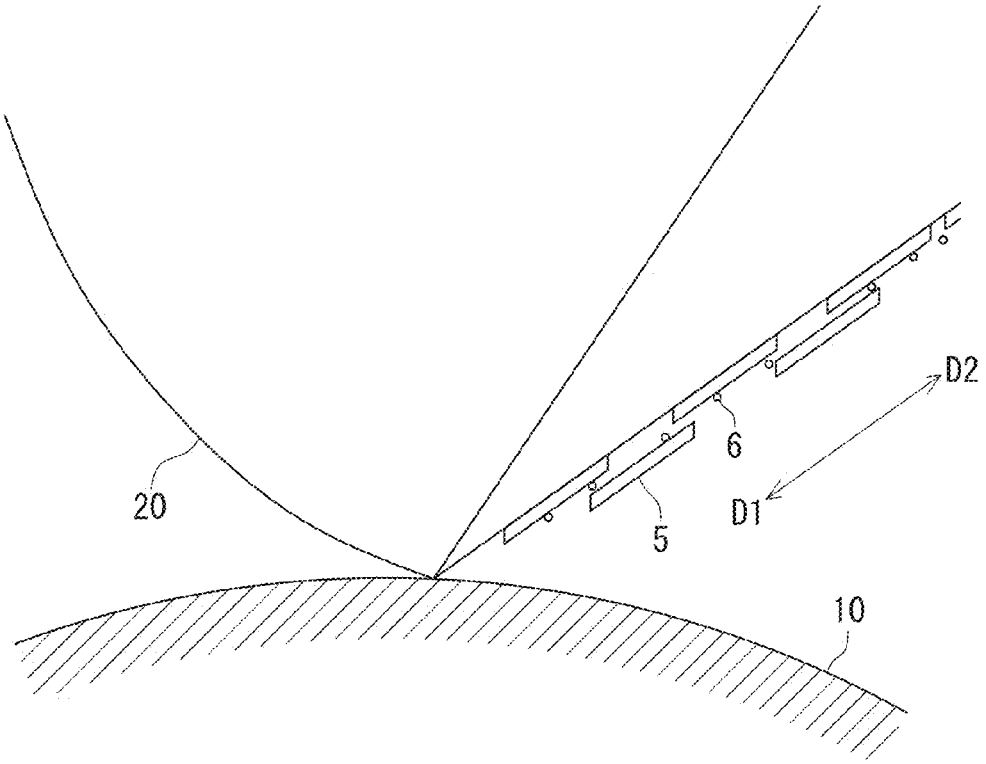
FIG. 3 is a diagram for illustrating formation of a blocking layer by first inorganic oxide particles included in the toner according to the embodiment of the present disclosure.

As already mentioned above, the toner has the first inorganic oxide particles 5. The presence of the first inorganic oxide particles 5 improves ease of toner cleaning. The following describes rationale for the improvement in ease of toner cleaning with reference to FIG. 3. FIG. 3 illustrates part of an image forming apparatus. The image forming apparatus includes a photosensitive member 10 and a cleaning section 20 (for example, a cleaning blade). The first inorganic oxide particles 5 tend to partially detach from the toner mother particles 2 to land on the photosensitive member 10 during an image formation process (in particular, after a development section 14 (see FIG. 6) has supplied the toner to a surface of the photosensitive member 10 and before the toner on the photosensitive member 10 reaches the cleaning section 20) in image formation with the use of the toner by the image forming apparatus. It is thought that the detached first inorganic oxide particles 5 form a blocking layer between the photosensitive member 10 and an edge of the cleaning section 20. A toner including toner mother particles 2 with high roundness (for example, toner mother particle 2 having an average roundness of no less than 0.960) tends to pass through a gap between the photosensitive member 10 and the cleaning section 20. However, formation of the blocking layer of the first inorganic oxide particles 5 makes it difficult even for the toner including the toner mother particles 2 with high roundness to pass through the gap between the photosensitive member 10 and the cleaning section 20. As a result, the toner remaining on the photosensitive member 10 is easily scraped off by the cleaning section 20, and thus ease of toner cleaning is improved.

As already mentioned above, the first inorganic oxide particles 5 are provided on surfaces of the toner mother particles 2 in a specific amount relative to mass of the toner mother particles 2. It is therefore thought that fluidity of the toner can be improved as well as ease of toner cleaning.

The following describes the toner mother particles 2, the first inorganic oxide particles 5, and the second inorganic oxide particles 6. The following also describes a carrier to be used for using the toner in the form of a two-component developer and a method for producing the toner.

<1. Toner Mother Particles>

The toner mother particles 2 have an average roundness of no less than 0.960, and preferably no less than 0.960 and no greater than 0.995. As a result of the toner mother particles 2 having a roundness of no less than 0.960, the toner mother particles 2 tend to have a uniform shape. The use of a toner including uniform toner mother particles 2 tends to facilitate stable formation of high-quality images. In contrast, as a result of the toner mother particles 2 having an average roundness of less than 0.960, ease of toner cleaning and fluidity of the toner tend to decrease.

The average roundness of the toner mother particles 2 can for example be determined as described below. The roundness of a toner mother particle 2 is measured using a flow particle imaging analyzer (for example, "FPIA (registered Japanese trademark) 3000", product of Malvern Instruments Ltd.). An appropriate number of toner mother particles 2 are measured for roundness as described above. A sum of values of the roundness thus obtained is divided by the number of toner mother particles 2 measured to determine an average roundness (arithmetic mean value) of the toner mother particles 2.

The toner mother particles 2 preferably have an average surface roughness (Rz) of no less than 50 nm and no greater than 150 nm, and more preferably no less than 85 nm and no greater than 105 nm. As a result of the toner mother particles 2 having an average surface roughness of no less than 50 nm, a contact area between each toner mother particle 2 and the first inorganic oxide particles 5 tends to be small. Accordingly, the first inorganic oxide particles 5 easily detach from the toner mother particle 2. That makes it easy to form a blocking layer of the detached first inorganic oxide particles 5 between the photosensitive member 10 and the cleaning section 20. As a result, ease of toner cleaning is thought to be further improved even if the toner includes the toner mother particles 2 with high roundness. The degree of detachment of the first inorganic oxide particles 5 from the toner mother particles 2 can be controlled by adjusting the average surface roughness of the toner mother particles 2. Thus, it is thought that ease of toner cleaning can be further improved. Furthermore, as a result of the toner mother particles 2 having an average surface roughness of no greater than 150 nm, the toner tends to have improved fluidity.

Figure 4:
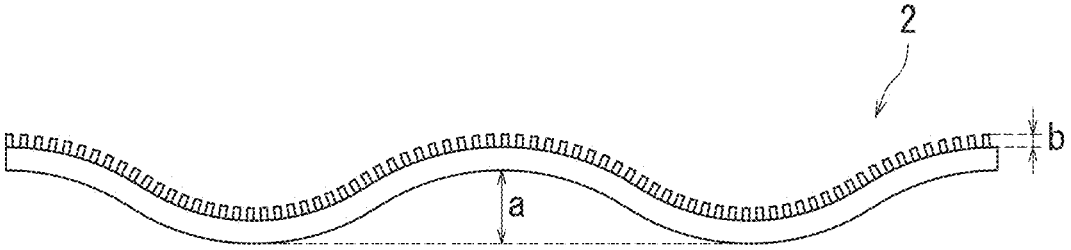
FIG. 4 is an enlarged cross-sectional view of a portion of a surface of a toner mother particle included in the toner according to the embodiment of the present disclosure.

The following describes the surface roughness of the toner mother particles 2 with reference to FIG. 4. FIG. 4 is an enlarged cross-sectional view of a portion of the surface of a toner mother particle 2 included in the toner. The surface of each toner mother particle 2 has irregularities a and irregularities b. The irregularities a are greater than the irregularities b. The irregularities a represent surface waviness of the toner mother particles 2. The irregularities a influence the above-described roundness of the toner mother particles 2. On the other hand, the irregularities b represent surface roughness of the toner mother particles 2.

The surface roughness of the toner mother particles 2 can for example be determined as described below. The surface roughness of a toner mother particle 2 is measured using a scanning probe microscope (SPM) ("multifunctional unit AFM5200S", product of Hitachi High-Tech Science Corporation). An appropriate number of toner mother particles 2 are measured for surface roughness as described above. A sum of values of the surface roughness thus obtained is divided by the number of toner mother particles 2 measured to determine an average surface roughness (arithmetic mean value) of the toner mother particles 2. A method for adjusting the average surface roughness of the toner mother particles 2 will be described in association with the method for producing the toner.

In the case of the non-capsule toner, the toner mother particles 2 may for example contain a binder resin, a colorant, a charge control agent, a releasing agent, and/or a magnetic powder. In the case of the capsule toner, the toner cores 3 of the toner mother particles 2 may for example contain a binder resin, a colorant, a charge control agent, a releasing agent, and/or a magnetic powder.

The following describes the binder resin, the colorant, the charge control agent, the releasing agent, and the magnetic powder. The following also describes the shell layers 4 of the toner mother particles 2 in the case of the capsule toner.

<1-1. Binder Resin>

No particular limitations are placed on the binder resin so long as it is a binder resin that is used for preparation of a toner. The binder resin is preferably a thermoplastic resin in terms of improving fixability of the toner. Examples of thermoplastic resins that can be used include acrylic acid-based resins, styrene-acrylic acid-based resins, polyester resins, polyamide resins, urethane resins, and vinyl alcohol-based resins. Particularly preferably, the binder resin is a polyester resin in terms of improving colorant dispersibility, toner chargeability, and toner fixability with respect to a recording medium (for example, paper). The following describes the polyester resin.

The polyester resin can for example be obtained through polycondensation or condensation copolymerization of an alcohol and a carboxylic acid.

The alcohol used for synthesis of the polyester resin may for example be a di-, tri-, or higher-hydric alcohol.

Examples of di-hydric alcohols that can be used include diols and bisphenols. Examples of diols that can be used include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol. Examples of bisphenols that can be used include bisphenol A, hydrogenated bisphenol A, bisphenol A ethylene oxide adduct, and bisphenol A propylene oxide adduct.

Examples of tri- or higher-hydric alcohols that can be used include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

The carboxylic acid used for synthesis of the polyester resin may for example be di-basic carboxylic acids and tri-, or higher-basic carboxylic acids.

Examples of di-basic carboxylic acids that can be used include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids, and alkenyl succinic acids. Examples of alkyl succinic acids that can be used include n-butylsuccinic acid, isobutylsuccinic acid, n-octylsuccinic acid, n-dodecylsuccinic acid, and isododecylsuccinic acid. Examples of alkenyl succinic acids that can be used include n-butenylsuccinic acid, isobutenylsuccinic acid, n-octenylsuccinic acid, n-dodecenylsuccinic acid, and isododecenylsuccinic acid.

Examples of tri- or higher-basic carboxylic acids that can be used include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

One of the alcohols listed above may be used independently, or two or more of the alcohols may be used in combination. One of the carboxylic acids listed above may be used independently, or two or more of the carboxylic acids may be used in combination. Alternatively, an ester-forming derivative of any of the carboxylic acids listed above may be used. Examples of ester-forming derivatives include acid halide, acid anhydride, and lower alkyl ester. In the present description, the term "lower alkyl" refers to an alkyl group having a carbon number of no less than 1 and no greater than 6.

The polyester resin preferably has an acid value of no less than 5 mgKOH/g and no greater than 30 mgKOH/g. The polyester resin preferably has a hydroxyl value of no less than 15 mgKOH/g and no greater than 80 mgKOH/g.

The acid value and the hydroxyl value of the polyester resin can be adjusted through adjustment of the amount of the alcohol and the amount of the carboxylic acid used during preparation of the polyester resin. An increase in the molecular weight of the polyester resin tends to cause a decrease in the acid value and the hydroxyl value of the polyester resin. The acid value and the hydroxyl value of the polyester resin can be measured in accordance with Japanese Industrial Standard (JIS) K0070-1992.

In a configuration in which a polyester resin is used for the binder resin, the amount of the polyester resin contained in the binder resin is preferably no less than 70% by mass, more preferably no less than 80% by mass, particularly preferably no less than 90% by mass, and most preferably 100% by mass.

In a configuration in which a thermoplastic resin is used for the binder resin, one of the thermoplastic resins listed above may be used independently, or two or more of the thermoplastic resins may be used in combination. A cross-linking agent or a thermosetting resin may be added to the thermoplastic resin. By introducing a cross-linking structure into part of the binder resin, preservability, shape retention, and durability of the toner can be readily improved while also maintaining satisfactory fixability of the toner.

Preferable examples of thermosetting resins that can be added to the thermoplastic resin include bisphenol A epoxy resins, hydrogenated bisphenol A epoxy resins, novolac epoxy resins, polyalkylene ether epoxy resins, cycloaliphatic epoxy resins, and cyanate-based resins. One of the thermosetting resins listed above may be used independently, or two or more of the thermosetting resins may be used in combination.

Preferably, the binder resin has a glass transition point (Tg) of no less than 30° C. and no greater than 60° C. The glass transition point of the binder resin is for example measured by the following method.

[Method for Measuring Glass Transition Point]

A heat absorption curve is plotted for the binder resin using a differential scanning calorimeter (DSC) (for example, "DSC-6220", product of Seiko Instruments Inc.). More specifically, 10 mg of the binder resin (measurement sample) is placed in an aluminum pan. An empty aluminum pan is used as a reference. A heat absorption curve for the binder resin is plotted in a measurement temperature range of from 25° C. to 200° C. and with a heating rate of 10° C./minute. The glass transition point of the binder resin is obtained based on the heat absorption curve (more specifically, from a point of change of specific heat of the binder resin).

Preferably, the binder resin has a softening point (Tm) of no less than 60° C. and no greater than 150° C. A plurality of different types of resins each having a different softening point may be combined such that the softening point of the binder resin falls within this range. The softening point of the binder resin is for example measured in accordance with the following method.

[Method for Measuring Softening Point]

The binder resin (sample) is set in a capillary rheometer (for example, "CFT-500D", product of Shimadzu Corporation). Melt-flow of 1 $cm^3$ of the sample is caused under conditions of a die diameter of 1 mm, a plunger load of 20 $kg/cm^2$, and a heating rate of 6° C./minute. Through the above, an S-shaped curve (stroke (mm)/temperature (° C.)) is plotted. The softening point of the sample is read from the S-shaped curve that is plotted. More specifically, in the S-shaped curve that is plotted, $S_1$ represents a maximum stroke value and $S_2$ represents a base line stroke value at low temperatures. A temperature corresponding to a stroke value of $(S_1+S_2)/2$ is taken as the softening point of the sample. Thus, the softening point of the binder resin (sample) is determined.

<1-2. Colorant>

The colorant can be a known pigment or dye that matches the color of the toner particles 1.

The colorant may be a black colorant. The black colorant is for example carbon black. A black colorant that is adjusted to a black color using colorants such as a yellow colorant, a magenta colorant, and a cyan colorant to be described later can be used.

The colorant may be a non-black colorant. The non-black colorant is for example a yellow colorant, a magenta colorant, or a cyan colorant.

Examples of yellow colorants that can be used include condensed azo compounds, isoindolinone compounds, anthraquinone compounds, azo metal complexes, methine compounds, and arylamide compounds. Specific examples thereof include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

Examples of magenta colorants that can be used include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples thereof include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Examples of cyan colorants that can be used include copper phthalocyanine, copper phthalocyanine derivatives, anthraquinone compounds, and basic dye lake compounds. Specific examples thereof include C.I. Pigment Blue (1, 7, 15, 15:1, 15:2, 15:3, 15:4, 60, 62, and 66), Phthalocyanine Blue, C.I. Vat Blue, and C.I. Acid Blue.

The amount of the colorant is preferably no less than 1 part by mass and no greater than 30 parts by mass relative to 100 parts by mass of the binder resin.

<1-3. Charge Control Agent>

The charge control agent is used in order to improve a charge level and a charge rise characteristic of the toner. The charge control agent is also used in order to obtain a toner having excellent durability and stability. The charge rise characteristic of the toner is an indicator as to whether the toner can be charged to a specific charge level in a short period of time. The charge control agent can be selected as appropriate from known charge control agents.

<1-4. Releasing Agent>

The releasing agent is for example used in order to improve fixability or offset resistance of the toner. The amount of the releasing agent is preferably no less than 1 part by mass and no greater than 30 parts by mass relative to 100 parts by mass of the binder resin, and more preferably no less than 5 parts by mass and no greater than 20 parts by mass in order to improve fixability and offset resistance of the toner.

Examples of releasing agents that can be used include aliphatic hydrocarbon waxes, oxides of aliphatic hydrocarbon waxes, plant waxes, animal waxes, mineral waxes, waxes having a fatty acid ester as a main component, and waxes in which a fatty acid ester is partially or fully deoxidized. Examples of aliphatic hydrocarbon waxes include ester wax, polyethylene wax (for example, low molecular weight polyethylene), polypropylene wax (for example, low molecular weight polypropylene), polyolefin copolymer, polyolefin wax, microcrystalline wax, paraffin wax, and Fischer-Tropsch wax. Examples of oxides of aliphatic hydrocarbon waxes include polyethylene oxide wax and block polymer of polyethylene oxide wax. Examples of plant waxes include candelilla wax, carnauba wax, Japan wax, jojoba wax, and rice wax. Examples of animal waxes include beeswax, lanolin, and spermaceti. Examples of mineral waxes include ozokerite, ceresin, and petrolatum. Examples of waxes having a fatty acid ester as a main component include montanic acid ester wax and castor wax. Examples of waxes in which a fatty acid ester is partially or fully deoxidized include deoxidized carnauba wax.

One of the releasing agents listed above may be used independently, or two or more of the releasing agents may be used in combination.

Preferably, the releasing agent has a melting point of no less than 50° C. and no greater than 100° C. As a result of the releasing agent having a melting point within the aforementioned range, the toner including the releasing agent tends to have improved low-temperature fixability and improved resistance to being hot offset. The melting point of the releasing agent can for example be measured using a differential scanning calorimeter (DSC) (for example, "DSC-6220", product of Seiko Instruments Inc.).

<1-5. Magnetic Powder>

Examples of magnetic powders that can be used include iron, ferromagnetic metals, alloys including either or both of iron and a ferromagnetic metal, compounds including either or both of iron and a ferromagnetic metal, ferromagnetic alloys subjected to ferromagnetization, and chromium dioxide. Examples of iron include ferrite and magnetite. Examples of ferromagnetic metals include cobalt and nickel. Examples of ferromagnetization include heat treatment.

The magnetic powder preferably has a particle size of no less than 0.1 μm and no greater than 1.0 μm. As a result of having a particle size within the aforementioned range, the magnetic powder tends to be easy to homogeneously disperse in the binder resin.

<1-6. Shell Layer>

In the case of the capsule toner, each toner mother particle 2 has the shell layer 4. The surfaces (shell layers 4) of the toner mother particles 2 in the capsule toner are hard, and therefore ease of toner cleaning is easily reduced. However, the toner according to the present embodiment has the first inorganic oxide particles 5 on the surfaces of the toner mother particles 2. Ease of toner cleaning can therefore be improved even in the case of the capsule toner.

In terms of capability of inhibiting aggregation of the toner particles 1 and high capability of forming films of the shell layers 4, examples of preferable resins that can be used to form the shell layers 4 include melamine resins, urea resins (for example, urea-resorcin resins), urethane resin, amide resins, olefin resins, and gelatin-gum arabic resins. In particular, melamine resins and urea resins are more preferable as having low water-absorption and good storage stability. The use of a resin having low water-absorption to form the toner particles 1 tends to prevent the toner particles 1 to bind to one another while being dried. As a result, the toner including the toner particles 1 tends to be restricted from a change in average particle size and a change in particle size distribution. Furthermore, the toner tends to be restricted from experiencing aggregation and decay of the toner particles 1 during storage.

A melamine resin is a polycondensate of melamine and formaldehyde. Therefore, melamine and formaldehyde are monomers for formation of the melamine resin. A urea resin is a polycondensate of urea and formaldehyde. Therefore, urea and formaldehyde are monomers for formation of the urea resin. These monomers may be modified in a known manner (for example, methylolation).

Preferably, the shell layers 4 have a thickness of no less than 1 nm and no greater than 20 nm. As a result of having a thickness of no less than 1 nm, the shell layers 4 tend not to rupture due to an impact during transportation. As a result of having a thickness of no greater than 20 nm, the shell layers 4 readily rupture upon application of pressure during fixing of the toner to a recording medium.

The thickness of the shell layers 4 can be measured by analyzing TEM images of cross-sections of the toner particles 1 using commercially available image analysis software. The commercially available image analysis software is for example WinROOF (product of Mitani Corporation). More specifically, two straight lines that perpendicularly intersect at approximately the center of a cross-section of a measurement target toner particle 1 are drawn and lengths of four segments where the two straight lines intersect the shell layer 4 are measured. The thickness of the shell layer 4 of the measurement target toner particle 1 is taken to be an average value of the measured lengths of the four segments. Such thickness measurement of the shell layer 4 is performed for at least 10 toner particles 1 to obtain an average value of the film thickness of the shell layers 4 for the measurement target toner particles 1. The average value is taken to be the film thickness of the shell layers 4 of the toner particles 1.

In a situation in which the shell layer 4 is too thin, it may be difficult to measure the thickness of the shell layer 4 due to a boundary between the shell layer 4 and the toner core 3 being unclear in a TEM image. In such a situation, the thickness of the shell layer 4 can be measured using a combination of TEM imaging and electron energy loss spectroscopy (EELS) to perform mapping in a TEM image of an element that is characteristic of the shell layer 4 (for example, nitrogen) and thus make clear the boundary between the shell layer 4 and the toner core 3.

In a configuration in which the toner mother particles 2 have the shell layers 4, the toner cores 3 coated by the shell layers 4 preferably have the following features.

The toner cores 3 are preferably anionic. As a result of the toner cores 3 being anionic, a material for forming a cationic shell layer 4 (hereinafter, may be referred to as "a shell material") can be easily attracted toward the surfaces of the toner cores 3 during formation of the shell layers 4. More specifically, the shell material that is for example positively charged in an aqueous medium is electrically attracted toward the toner cores 3 that are negatively charged in the aqueous medium. Then, the shell layers 4 are formed on the surfaces of the toner cores 3 through, for example, in-situ polymerization. As a result, the toner cores 3 are not excessively dispersed in the aqueous medium through use of a dispersant, and the shell layers 4 tend to be readily formed on the surfaces of the toner cores 3 in a uniform manner.

The binder resin is a main component (for example, no less than 85% by mass) of the toner cores 3. Consequently, polarity of the toner cores 3 is largely influenced by polarity of the binder resin. The toner cores 3 have a higher tendency to be anionic in a situation in which the binder resin has, for example, an ester group, a hydroxyl group, an ether group, an acid group, or a methyl group. The toner cores 3 have a higher tendency to be cationic in a situation in which the binder resin has, for example, an amino group, an amine, or an amide group.

As described in association with the method for producing the toner, the toner particles 1 included in the toner according to the present embodiment are prepared by coating the toner cores 3 with the shell layers 4 through curing the shell material (for example, a monomer of a thermosetting resin). It is therefore preferable to use a binder resin having a functional group (for example, a hydroxyl group or a carboxyl group) that can react with the shell material (for example, a monomer of a thermosetting resin). As a result of the use of such a binder resin, it is thought that the functional group that can react with the shell material is exposed at the surfaces of the toner cores 3 containing the binder resin. The functional group (for example, a hydroxyl group or a carboxyl group) exposed at the surfaces of the toner cores 3 react with a monomer of a thermosetting resin (for example, methylol melamine) during coating of the surfaces of the toner cores 3 with the shell layers 4. Thus, covalent bonds are readily formed between the toner cores 3 and the shell layers 4. Therefore, the use of a binder resin having a functional group (for example, a hydroxyl group or a carboxyl group) that can react with the shell material (for example, a monomer of a thermosetting resin) facilitates the shell layers 4 and the toner cores 3 to be strongly bound to one another. As a result, the shell layers 4 do not easily come off the toner cores 3 even in a situation in which stress is applied to the toner particles 1 for a long period of time.

The toner cores 3 having a negative zeta potential (i.e., less than 0 V) when measured in an aqueous medium adjusted to pH 4 is an indicator that the toner cores 3 are anionic. The toner cores 3 preferably have a negative zeta potential (i.e., less than 0 V) when measured in an aqueous medium adjusted to pH 4, and more preferably a zeta potential of no greater than −10 mV. In order that the toner cores 3 and the shell layers 4 bond more strongly to one another, the toner cores 3 preferably have a zeta potential at pH 4 of less than 0 V and the toner particles 1 (and thus also the shell layers 4) preferably have a zeta potential at pH 4 of greater than 0 V. Note that a pH of 4 is the same as the pH of the aqueous medium for formation of the shell layers 4.

Examples of methods for measuring the zeta potential include an electrophoresis method, an ultrasound method, and an electric sonic amplitude (ESA) method.

The electrophoresis method involves applying an electrical field to a liquid dispersion of particles, thereby causing electrophoresis of charged particles in the dispersion, and measuring the zeta potential based on the rate of electrophoresis. An example of the electrophoresis method is laser Doppler electrophoresis. In the laser Doppler electrophoresis, particles undergoing electrophoresis are irradiated with laser light and the rate of electrophoresis of the particles is calculated from an amount of Doppler shift of scattered light that is obtained. Advantages of laser Doppler electrophoresis are a lack of necessity for particle concentration in the dispersion to be high, a low number of parameters being necessary for calculating the zeta potential, and a good degree of sensitivity in detection of the rate of electrophoresis.

The ultrasound method involves irradiating a liquid dispersion of particles with ultrasound, thereby causing vibration of charged particles in the dispersion, and measuring the zeta potential based on an electric potential difference that arises due to the vibration.

The ESA method involves applying a high frequency voltage to a liquid dispersion of particles, thereby causing charged particles in the dispersion to vibrate and generate ultrasound. The zeta potential is then measured based on the magnitude (intensity) of the ultrasound.

An advantage of the ultrasound method and the ESA method is that the zeta potential can be measured to a good degree of sensitivity even when particle concentration of the dispersion is high (for example, exceeding 20% by mass).

[Method for Measuring Zeta Potential of Toner Cores in pH 4 Aqueous Medium]

The following describes a specific example of a method for measuring the zeta potential of the toner cores 3 in the aqueous medium adjusted to pH 4. A magnetic stirrer is used to mix 0.2 g of the toner cores 3, 80 g of ion exchanged water, and 20 g of a 1% by mass concentration non-ionic surfactant (polyvinylpyrrolidone, "K-85", product of Nippon Shokubai Co.) to uniformly disperse the toner cores 3 in the liquid to yield a dispersion. Next, the dispersion is adjusted to pH 4 through addition of dilute hydrochloric acid to yield a pH 4 dispersion (measurement sample) of the toner cores 3. A zeta potential and particle size distribution analyzer ("Delsa Nano HC", product of Beckman Coulter, Inc.) is used to measure the zeta potential of the toner cores 3 in the measurement sample.

The toner cores 3 having a negative triboelectric charge (less than 0 μC/g) as measured using a standard carrier is another indicator that the toner cores 3 are anionic. The triboelectric charge indicates how readily the toner cores 3 are charged. The triboelectric charge also indicates whether the toner cores 3 tend to be charged to positive or negative polarity. The toner cores 3 preferably have a negative triboelectric charge (less than 0 μC/g), and more preferably a triboelectric charge of no greater than −10 μC/g. The following describes a method for measuring the triboelectric charge in detail.

[Method for Measuring Triboelectric Charge]

A TURBULA (registered Japanese trademark) mixer is used to mix 100 parts by mass of a standard carrier N−01 (standard carrier for negative-charging toner) provided by The Imaging Society of Japan and 7 parts by mass of the toner cores 3 for 30 minutes. After mixing, the triboelectric charge of the toner cores 3 is measured using a Q/m meter ("MODEL 210HS-2A", product of Trek, Inc.). The triboelectric charge of the toner cores 3, measured as described above, indicates how readily the toner cores 3 are charged and whether the toner cores 3 tend to be charged to positive or negative polarity.

<2. First Inorganic Oxide Particles>

The first inorganic oxide particles 5 are disposed on a surface of each toner mother particle 2. As already mentioned above, the first inorganic oxide particles 5 tend to partially detach from the toner mother particles 2 in image formation with the use of the toner by an image forming apparatus. The detached first inorganic oxide particles 5 form a blocking layer between the photosensitive member 10 and the edge of the cleaning section 20 in the image forming apparatus. Formation of the blocking layer makes it difficult even for the toner including the toner mother particles 2 with high roundness to pass through the gap between the photosensitive member 10 and the cleaning section 20. As a result, ease of toner cleaning is thought to be improved.

The first inorganic oxide particles 5 are for example particles of silica or a metal oxide. Examples of metal oxides that can be used include alumina, titanium oxide (for example, titanium(IV) dioxide), magnesium oxide, zinc oxide, strontium titanate, and barium titanate. Preferably, the first inorganic oxide particles 5 are acicular.

The first inorganic oxide particles 5 have an average major axis diameter of no less than 500 nm and no greater than 3,000 nm, an average minor axis diameter of no less than 100 nm and no greater than 250 nm, and an aspect ratio of no less than 2 and no greater than 20. The first inorganic oxide particles 5 preferably have an aspect ratio of no less than 11 and no greater than 20, and more preferably no less than 11 and no greater than 18. As a result of the first inorganic oxide particles 5 having an average major axis diameter, and an average minor axis diameter, and an aspect ratio within the aforementioned ranges, adhesion of the first inorganic oxide particles 5 to the toner mother particles 2 is reduced, and thus the first inorganic oxide particles 5 readily detach from the toner mother particles 2. Furthermore, the first inorganic oxide particles 5 are prevented from being embedded in the surfaces of the toner mother particles 2 by stress (friction) applied in the development section 14 (see FIG. 6; for example, a developing device). Furthermore, as a result of having the specific shape, the first inorganic oxide particles 5 tend to be arranged in an axial direction of the photosensitive member 10 (D1-D2 direction in FIG. 3) to readily close the gap between the photosensitive member 10 and the edge of the cleaning section 20. In addition, the first inorganic oxide particles 5 themselves tend not to pass through the gap between the photosensitive member 10 and the cleaning section 20. As a result, the blocking layer of the first inorganic oxide particles 5 is effectively formed between the photosensitive member 10 and the edge of the cleaning section 20, improving ease of toner cleaning. If the average major axis diameter, the average minor axis diameter, or the aspect ratio of the first inorganic oxide particles 5 is too large, the toner tends to have reduced fluidity.

The average major axis diameter, the average minor axis diameter, and the aspect ratio of the first inorganic oxide particles 5 are for example determined as described below. A first inorganic oxide particle 5 is observed and an image thereof is captured using a scanning electron microscope (for example, "JSM-7500F", product of JEOL Ltd.). The captured image is analyzed using image analysis software. A major axis diameter and a minor axis diameter of the first inorganic oxide particle 5 are determined through the analysis. An appropriate number of first inorganic oxide particles 5 are measured for major axis diameter and minor axis diameter as described above. A sum of values of the major axis diameter obtained and a sum of values of the minor axis diameter obtained are divided by the number of first inorganic oxide particles 5 measured to determine an average major axis diameter (arithmetic mean value) and an average minor axis diameter (arithmetic mean value), respectively. An aspect ratio of the first inorganic oxide particles 5 (average major axis diameter/average minor axis diameter) is calculated by dividing the average major axis diameter by the average minor axis diameter.

The following describes an example of a method for preparing the first inorganic oxide particles 5 having a specific average major axis diameter, a specific average minor axis diameter, and a specific aspect ratio. For a configuration in which the first inorganic oxide particles 5 are titanium oxide particles, the titanium oxide particles are prepared by dripping liquid titanium alkoxide (raw material) into a solvent and subjecting the resultant liquid to stirring or ultrasound treatment for a specific period of time.

Alcohol is used as the solvent. The alcohol includes at least methanol and water. The amount of the solvent is no less than 5 mL and no greater than 500 mL relative to 1 mL of titanium alkoxide. The pressure of the reaction system is for example standard pressure (no less than 0.09 MPa and no greater than 0.11 MPa). The temperature of the solvent is for example no less than 10° C. and no greater than 60° C. Stirring is for example performed at a rate of no less than 500 rpm and no greater than 1,000 rpm. Ultrasound treatment is for example performed at an ultrasound irradiation frequency of no less than 10 kHz and no greater than 60 kHz. Ultrasound irradiation may be performed not only during dripping of titanium alkoxide but also during a period from completion of the dripping to substantial end of growth of titanium oxide particles (for example, acicular titanium oxide particles). Dripping of titanium alkoxide is for example performed by taking no less than 10 seconds and no greater than one minute where the amount of the solvent is no less than 0.1 L and no greater than 0.2 L and the amount of titanium alkoxide is no less than 1.0 mL and no greater than 5.0 mL.

Through the aforementioned reaction, solid acicular titanium oxide particles are caused to deposit. During the reaction, the average minor axis diameter of the acicular titanium oxide particles is maintained substantially constant. However, the average major axis diameter thereof increases (grows) with time. The growth of the average major axis diameter of the acicular titanium oxide particles is for example observed using a scanning electron microscope. The rate of the major axis diameter growth of the acicular titanium oxide particles is substantially the same among the particles. It is therefore possible to control the aspect ratio while fixing the average minor axis diameter of the acicular titanium oxide particles by adjusting the reaction time. Furthermore, it is likely that acicular titanium oxide particles having a uniform minor axis diameter and a uniform major axis diameter and having a narrow particle size distribution are obtained.

The average minor axis diameter of the acicular titanium oxide particles can be controlled by changing the reaction temperature and the composition of the solvent in the aforementioned reaction. For example, the average minor axis diameter is increased by increasing the reaction temperature. Thus, titanium oxide particles having a specific average major axis diameter, a specific average minor axis diameter, and a specific aspect ratio can be obtained.

A commercially available product may be used as the first inorganic oxide particles 5. Examples of commercially available first inorganic oxide particles 5 include FTL-100 (product of ISHIHARA SANGYO KAISHA, LTD., average major axis diameter: 1680 nm, average minor axis diameter: 130 nm, aspect ratio: 12.9) and FTL-200 (product of ISHIHARA SANGYO KAISHA, LTD., average major axis diameter: 2860 nm, average minor axis diameter: 210 nm, aspect ratio: 13.6). Alternatively, commercially available acicular inorganic oxide particles may be pulverized using a jet mill (for example, supersonic jet pulverizer "Jet Mill IDS-2", product of Nippon Pneumatic Mfg. Co., Ltd.) and thus adjusted to have a specific average major axis diameter, a specific average minor axis diameter, and a specific aspect ratio to be used as the first inorganic oxide particles 5.

Preferably, surfaces of the first inorganic oxide particles 5 are conductive treated. The first inorganic oxide particles 5 tend to form a blocking layer between the photosensitive member 10 and the edge of the cleaning section 20. The first inorganic oxide particles 5 therefore tend to stay in contact with the surface of the photosensitive member 10 for a long period of time. As a result of the surfaces of the first inorganic oxide particles 5 being conductive treated, the resistance of the first inorganic oxide particles 5 is reduced and thus the first inorganic oxide particles 5 are less likely to store charge. Consequently, insulation breakdown in the photosensitive member 10 tends to be reduced. The first inorganic oxide particles 5 are conductive treated by being coated with a conductive material. Examples of conductive materials that can be used for the treatment include tin and antimony.

For the first inorganic oxide particles 5, one inorganic oxide may be used independently, or two or more inorganic oxides may be used in combination.

The first inorganic oxide particles 5 are contained in an amount of no less than 1.0% by mass and no greater than 2.0% by mass relative to mass of the toner mother particles 2. If the amount of the first inorganic oxide particles 5 is too small, the amount of first inorganic oxide particles 5 that detach from the toner mother particles 2 during image formation tends to decrease. As a result, the blocking layer of the first inorganic oxide particles 5 is not effectively formed between the photosensitive member 10 and the edge of the cleaning section 20, and ease of toner cleaning is likely to decrease. If the amount of the first inorganic oxide particles 5 is too large, the toner tends to have reduced fluidity.

Preferably, no less than 50% by number and no greater than 90% by number of the first inorganic oxide particles 5 relative to the total number of first inorganic oxide particles 5 detach from the toner mother particles 2 to land on the photosensitive member 10 during a period of image formation with the use of the toner by an image forming apparatus including the photosensitive member 10 (more specifically, during a period from the toner being supplied to the surface of the photosensitive member 10 by the development section 14 to the toner on the photosensitive member 10 reaching the cleaning section 20). Hereinafter, a ratio of the number of first inorganic oxide particles 5 that detach from the toner mother particles 2 to land on the photosensitive member 10 in image formation with the use of the toner by an image forming apparatus including the photosensitive member 10 relative to the total number of first inorganic oxide particles 5 may be referred to as "a detachment ratio". As a result of the detachment ratio being within the aforementioned range, the blocking layer of the first inorganic oxide particles 5 is effectively formed and ease of toner cleaning is further improved. Preferably, the detachment ratio is no less than 70% by number and no greater than 85% by number.

The detachment ratio is calculated in accordance with formula 1 shown below. In the formula 1, P1 represents the number of first inorganic oxide particles 5 per unit area with respect to the first inorganic oxide particles 5 present on the surface of a toner mother particle 2 included in the toner before being used in image formation. P2 represents the number of first inorganic oxide particles 5 per unit area with respect to the first inorganic oxide particles 5 present on the surface of a toner mother particle 2 included in the toner remaining in the developing device after image formation. P1 and P2 can for example be determined through observation of the surfaces of the toner particles 1 before and after image formation using a scanning electron microscope (for example, "JSM-7500F", product of JEOL Ltd.). Detachment of the first inorganic oxide particles 5 from the toner mother particles 2 mostly occurs on the photosensitive member 10. Therefore, the detachment ratio with respect to the first inorganic oxide particles 5 on the photosensitive member 10 is substantially the same as the detachment ratio with respect to the first inorganic oxide particles 5 that is obtained through measuring the toner remaining in the developing device.

$$\text{Detachment ratio[\% by number]} = 100 \times (P1 - P2)/P1 \quad (1)$$

Figure 5A:
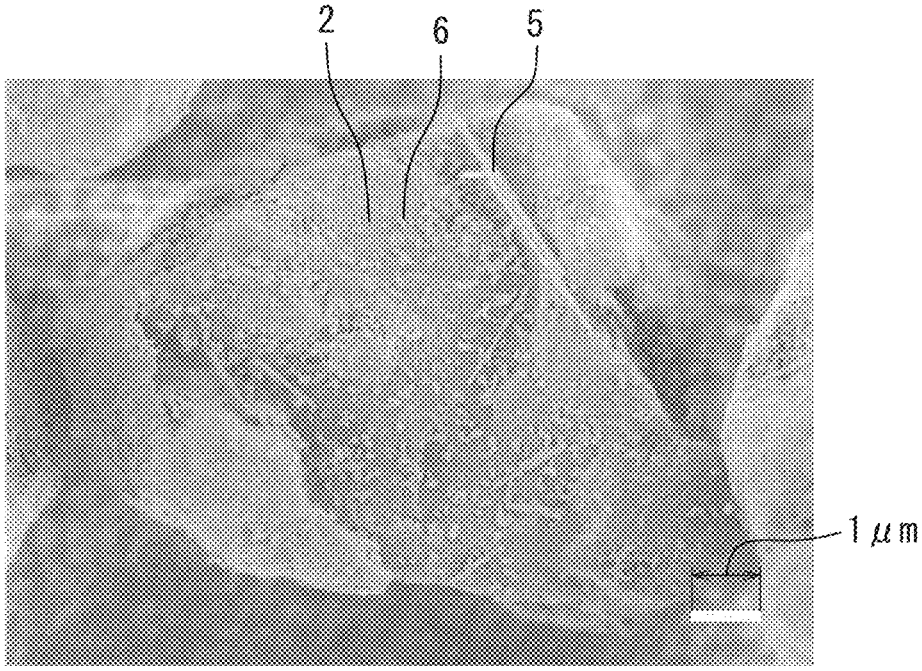
FIGS. 5A and 5B are photographs taken using a scanning electron microscope (SEM), each showing a surface of a toner particle included in the toner according to the embodiment of the present disclosure.
Figure 5B:
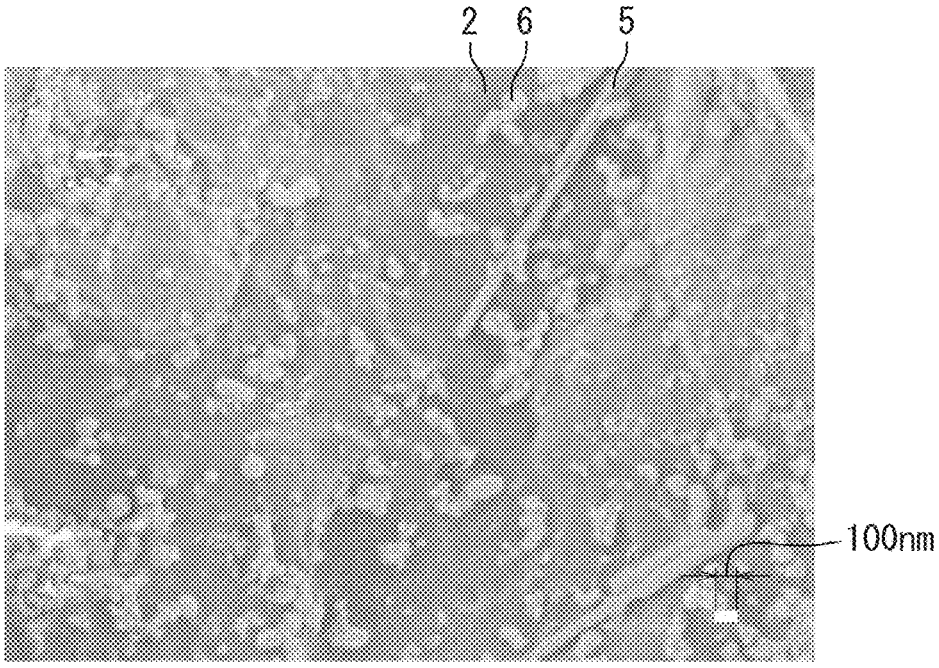

FIGS. 5A and 5B show examples of photographs taken during observation of the surfaces of toner particles 1 using a scanning electron microscope. FIG. 5A is a photograph of the surface of a toner particle 1 observed at a magnification of ×10,000 using a scanning electron microscope ("JSM-7500F", product of JEOL Ltd.). FIG. 5B is a photograph of the surface of a toner particle 1 observed at a magnification of ×30,000 using a scanning electron microscope ("JSM-7500F", product of JEOL Ltd.). A scale bar in FIG. 5A measures 1 μm, and a scale bar in FIG. 5B measures 100 nm. P1 and P2 are determined by performing the above-described observation on the surface of a toner particle 1.

The detachment ratio can for example be calculated through image formation using a color copier ("TASKalfa 5550ci", product of KYOCERA Document Solutions Inc.). Conditions for the image formation are for example as described later in Examples.

Figure 6:
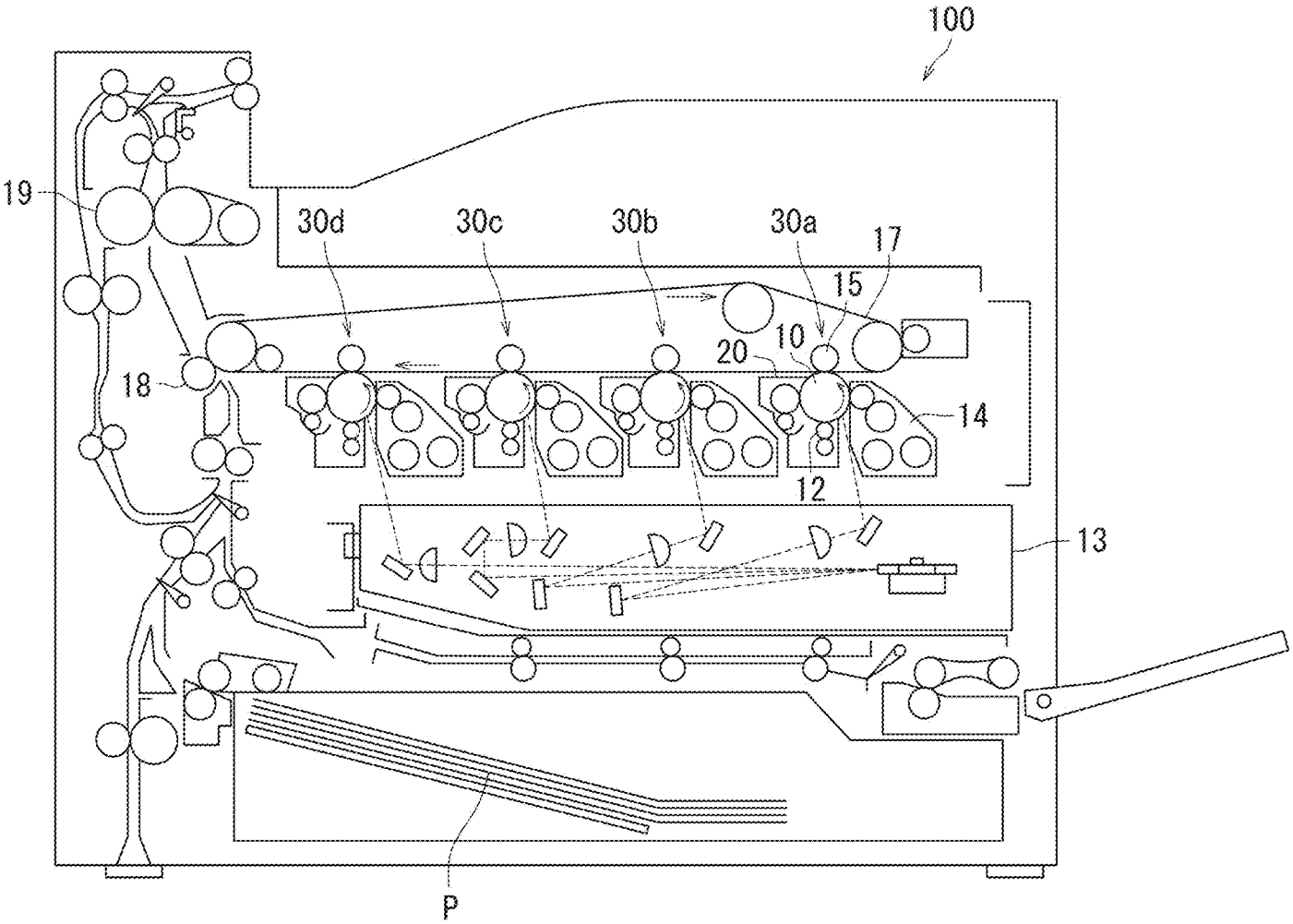
FIG. 6 is a diagram illustrating an example of configuration of an image forming apparatus in which the toner according to the embodiment of the present disclosure is used.

The following describes an image forming apparatus and an image forming method with the use of the toner according to the present embodiment with reference to FIG. 6. FIG. 6 illustrates an example of configuration of an image forming apparatus 100 in which the toner according to the present embodiment is used. The image forming apparatus 100 for example includes the photosensitive member 10, the development section 14, and the cleaning section 20. The toner according to the present embodiment (toner including the toner particles 1) is used in the image forming apparatus 100. A developer including the toner is stored in the development section 14. The image forming apparatus 100 may further include a charger 12, a light exposure section 13, a transfer section (corresponding to a primary transfer section 15, a transfer belt 17, and a secondary transfer section 18 in a configuration adopting an intermediate transfer process; or corresponding to the primary transfer section 15 and the transfer belt 17 in a configuration adopting a direct transfer process), and a fixing section 19.

The image forming method that is performed by the image forming apparatus 100 includes a developing process and a cleaning process. The image forming method may further include one or more of a charging process, a light exposure process (electrostatic latent image forming process), a transfer process, and a fixing process.

In the charging process, the charger 12 charges the surface of the photosensitive member 10. The charger 12 may have any charge polarity. For example, the charger 12 may positively charge the surface of the photosensitive member 10, and the development section 14 may supply positively charged toner to the surface of the photosensitive member 10 to develop an electrostatic latent image thereon into a toner image.

In the light exposure process (electrostatic latent image forming process), the light exposure section 13 exposes the charged surface of the photosensitive member 10 with light. As a result, an electrostatic latent image is formed on the surface of the photosensitive member 10.

In the developing process, the development section 14 supplies toner (toner including the toner particles 1) to the electrostatic latent image formed on the surface of the photosensitive member 10. As a result, the electrostatic latent image is developed into a toner image.

In the transfer process, the transfer section transfers the toner image from the surface of the photosensitive member 10 to a recording medium P. The transfer section performs the transfer for example by an intermediate transfer process (hereinafter, may be referred to as an intermediate transfer belt transfer process) or by a direct transfer process. The transfer section adopting the intermediate transfer process corresponds to the primary transfer section 15, the transfer belt 17, and the secondary transfer section 18. According to the intermediate transfer process, the primary transfer section 15 performs primary transfer of a toner image from the photosensitive member 10 to the transfer belt 17. Subsequently, the secondary transfer section 18 performs secondary transfer of the toner image from the transfer belt 17 to the recording medium P. The transfer section adopting the direct transfer process corresponds to the primary transfer section 15 and the transfer belt 17 (equivalent to a conveyor belt). According to the direct transfer process, the primary transfer section 15 transfers a toner image from the photosensitive member 10 to the recording medium P being conveyed by the transfer belt 17. According to the direct transfer process, the photosensitive member 10 comes in contact with the recording medium P when the toner image is transferred to the recording medium P. In the image forming apparatus 100 adopting the direct transfer process, the secondary transfer section 18 is omitted.

In the cleaning process, the cleaning section 20 cleans toner remaining on the surface of the photosensitive member 10. The cleaning section 20 is for example a cleaning blade.

During a period of image formation with the use of the toner by the image forming apparatus 100, some of the first inorganic oxide particles 5 included in the toner detach from the toner mother particles 2 to land on the photosensitive member 10. More specifically, the period of image formation (i.e., in image formation) is a period from the toner being supplied to the surface of the photosensitive member 10 by the development section 14 to the toner on the photosensitive member 10 reaching the cleaning section 20. As already mentioned above, the first inorganic oxide particles 5 that have detached and landed on the photosensitive member 10 are thought to form the blocking layer between the photosensitive member 10 and the edge of the cleaning section 20. The toner including the toner mother particles 2 with high roundness (for example, toner mother particles 2 having an average roundness of no less than 0.960) easily passes through the gap between the photosensitive member 10 and the cleaning section 20. However, formation of the blocking layer of the first inorganic oxide particles 5 makes it difficult even for the toner including the toner mother particles 2 with high roundness to pass through the gap between the photosensitive member 10 and the cleaning section 20. It is therefore thought that the toner remaining on the photosensitive member 10 is easily scraped off by the cleaning section 20 and thus ease of toner cleaning is improved. Preferably, no less than 50% by number and no greater than 90% by number of first inorganic oxide particles 5 relative to the total number of first inorganic oxide particles 5 detach from the toner mother particles 2 to land on the photosensitive member 10 in image formation with the use of the toner by the image forming apparatus 100 including the photosensitive member 10.

After the unfixed toner image is transferred to the recording medium P, the fixing section 19 fixes the unfixed toner image to the recording medium P through application of either or both of heat and pressure in the fixing process. As a result, an image is formed on the recording medium P.

No particular limitations are placed on the image forming apparatus 100 so long as it is an electrophotographic image forming apparatus. The image forming apparatus 100 may for example be a monochrome image forming apparatus or a color image forming apparatus. The image forming apparatus 100 may be a tandem color image forming apparatus that forms toner images of different colors using different color toners. In a configuration in which the image forming apparatus 100 is a monochrome image forming apparatus, the image forming apparatus 100 for example includes an image forming unit 30*a*. The image forming unit 30*a* includes the photosensitive member 10, the charger 12, the development section 14, the primary transfer section 15, and the cleaning section 20. The photosensitive member 10 is disposed at a central position in the image forming unit 30*a*. The photosensitive member 10 is rotatable in an arrow direction (in a counterclockwise direction). Around the photosensitive member 10, the charger 12, the development section 14, the primary transfer section 15, and the cleaning section 20 are arranged in stated order from upstream to downstream in a rotation direction of the photosensitive member 10. In a configuration in which the image forming apparatus 100 is a tandem color image forming apparatus, the image forming apparatus 100 for example includes image forming units 30*a*, 30*b*, 30*c*, and 30*d*. The image forming unit 30*b*, 30*c*, and 30*d* have the same configuration as the image forming unit 30*a*.

<3. Second Inorganic Oxide Particles>

The toner particles 1 may further include the second inorganic oxide particles 6 in addition to the first inorganic oxide particles 5. In a configuration in which the toner particles 1 include the second inorganic oxide particles 6, the second inorganic oxide particles 6 are disposed so as to cover each of the toner mother particles 2. The first inorganic oxide particles 5 are disposed on the surfaces of the toner mother particles 2 on which the second inorganic oxide particles 6 are disposed. In other words, the second inorganic oxide particles 6 are disposed on an outer side of each toner mother particle 2, and the first inorganic oxide particles 5 are disposed on outer sides of the second inorganic oxide particles 6. The second inorganic oxide particles 6 are in contact with the surface of each toner mother particle 2. The first inorganic oxide particles 5 are in contact with the second inorganic oxide particles 6. The second inorganic oxide particles 6 in contact with the first inorganic oxide particles 5 are located between the surface of each toner mother particle 2 and the first inorganic oxide particles 5.

In a configuration in which the toner particles 1 include the second inorganic oxide particles 6, it is preferable to produce the toner as described below. First, the second inorganic oxide particles 6 are caused to adhere to the surfaces of the toner mother particles 2 (first external additive addition step). Next, the first inorganic oxide particles 5 are caused to adhere to the surfaces of the toner mother particles 2 having the second inorganic oxide particles 6 adhering thereto (second external additive addition step).

The first inorganic oxide particles 5 are less likely to be in direct contact with the surfaces of the toner mother particles 2 in the toner particles 1 prepared as described above. Accordingly, the first inorganic oxide particles 5 detach from the toner mother particles 2 more easily. It is therefore thought that ease of toner cleaning is further improved by the blocking layer of the detached first inorganic oxide particles 5.

The second inorganic oxide particles 6 are for example particles of silica or a metal oxide. Examples of metal oxides that can be used include alumina, titanium oxide (for example, titanium(IV) dioxide), magnesium oxide, zinc oxide. strontium titanate, and barium titanate. No particular limitations are placed on the shape of the second inorganic oxide particles 6, and the second inorganic oxide particles 6 are for example spherical.

The second inorganic oxide particles 6 preferably have a volume median diameter ($D_{50}$) of no greater than 50 nm, more preferably no less than 10 nm and no greater than 50 nm, and particularly preferably no less than 15 nm and no greater than 50 nm.

The second inorganic oxide particles 6 are preferably contained in an amount of no less than 0.5% by mass and no greater than 3.0% by mass relative to mass of the toner mother particles 2, more preferably no less than 0.5% by mass and no greater than 2.0% by mass, and particularly preferably no less than 0.5% by mass and no greater than 1.0% by mass.

Preferably, the second inorganic oxide particles 6 cover no less than 50% and no greater than 100% of a surface area of each toner mother particle 2.

For the second inorganic oxide particles 6, one inorganic oxide may be used independently, or two or more inorganic oxides may be used in combination.

The toner particles 1 may have an additional external additive other than the first inorganic oxide particles 5 and the second inorganic oxide particles 6. A known external additive can be selected as appropriate as the additional external additive. The additional external additive preferably has a number average particle size of no less than 1 nm and no greater than 1 μm, and more preferably no less than 1 nm and no greater than 50 nm. Preferably, the amount of the external additive is no less than 0.5 parts by mass and no greater than 10 parts by mass relative to 100 parts by mass of the toner mother particles 2.

<4. Carrier>

The toner may be used as a one-component developer. Alternatively, the toner may be mixed with a desired carrier and used in a two-component developer. Preferably, a magnetic carrier is used for preparation of the two-component developer.

A carrier in which carrier cores are coated by a resin may be used. Alternatively, a resin carrier in which carrier cores are dispersed in a resin may be used.

Examples of the carrier cores include: particles of iron, oxidized iron, reduced iron, magnetite, copper, silicon steel, ferrite, nickel, or cobalt; particles of an alloy of any of the above materials with a metal (for example, manganese, magnesium, zinc, or aluminum); particles of iron-nickel alloy; particles of iron-cobalt alloy; particles of a ceramic; and particles of a high-dielectric substance. Examples of ceramics include titanium oxide, aluminum oxide, copper oxide, magnesium oxide, lead oxide, zirconium oxide, silicon carbide, magnesium titanate, barium titanate, lithium titanate, lead titanate, lead zirconate, and lithium niobate. Examples of high-dielectric substances include ammonium dihydrogen phosphate, potassium dihydrogen phosphate, and Rochelle salt. One type of the carrier cores listed above may be used independently, or two or more types of the carrier cores may be used in combination.

Examples of the resin coating the carrier cores include acrylic acid-based polymers, styrene-based polymers, styrene-acrylic acid-based copolymers, olefin polymers, polyvinyl chloride, polyvinyl acetate, polycarbonate, cellulose resins, polyester resins, unsaturated polyester resins, polyamide resins, urethane resins, epoxy resins, silicone resins, fluororesins, phenolic resins, xylene resins, diallyl phthalate resins, polyacetal resins, and amino resins. Examples of olefin polymers include polyethylene, chlorinated polyethylene, and polypropylene. Examples of fluororesins include polytetrafluoroethylene, polychlorotrifluoroethylene, and polyvinylidene fluoride. One of the resins listed above may be used independently, or two or more of the resins may be used in combination.

The carrier preferably has a particle size of no less than 20 μm and no greater than 120 μm, and more preferably no less than 25 μm and no greater than 80 μm. The particle size of the carrier can be measured using an electron microscope.

In a configuration in which the toner is used in a two-component developer, the toner is preferably contained in an amount of no less than 3% by mass and no greater than 20% by mass relative to mass of the two-component developer, and more preferably no less than 5% by mass and no greater than 15% by mass.

<5. Method for Producing Toner>

The following describes an example of a method for producing the toner. In a configuration in which the toner is a non-capsule toner, the toner cores 3 obtained through a step of forming the toner cores 3 are subjected to a washing step without going through a step of forming the shell layers 4. That is, the toner cores 3 are equivalent to the toner mother particles 2. In contrast, in a configuration in which the toner is a capsule toner, the toner mother particles 2 are prepared through the step of forming the toner cores 3 and the step of forming the shell layers 4.

<5-1. Step of Forming Toner Cores>

The toner cores 3 may for example be formed by an aggregation method or a pulverization method. The aggregation method produces toner cores 3 with high roundness more easily than the pulverization method. Furthermore, the aggregation method produces toner cores 3 having a uniform shape and a uniform particle size easily. On the other hand, the pulverization method is simpler than the aggregation method for production of the toner cores 3.

In a configuration in which the toner is a capsule toner and the shell layers 4 include a thermosetting resin, the shell material is cured through heating in the step of forming the shell layers 4. In the step of forming the shell layers 4, the toner cores 3 tend to contract by surface tension while softening. The toner cores 3 are increased in roundness due to contraction of the toner cores 3. In the case of toner mother particles 2 having shell layers 4 including a thermosetting resin, therefore, toner mother particles 2 with high roundness tend to be produced even if the toner cores 3 are formed by the pulverization method, because the toner cores 3 are increased in roundness in the step of forming the shell layers 4.

The following describes an example of the pulverization method. First, a binder resin, a colorant, a charge control agent, a releasing agent, and a magnetic powder are mixed. Next, the resultant mixture is melt-kneaded. Next, the resultant melt-kneaded is pulverized and classified. As a result, toner cores 3 having a desired particle size are obtained.

The following describes an example of the aggregation method. First, fine particles of a binder resin, fine particles of a colorant, fine particles of a charge control agent, fine particles of a releasing agent, and/or fine particles of a magnetic powder are aggregated in an aqueous medium to give aggregated particles. During aggregation, the toner cores 3 preferably have a negative zeta potential (i.e., less than 0 V) when measured in an aqueous medium adjusted to pH 4, and more preferably a zeta potential of no greater than −10 mV. Next, the aggregated particles are heated to cause components contained in the aggregated particles to coalesce. As a result, an aqueous dispersion containing the toner cores 3 is obtained. Thereafter, the toner cores 3 are collected through removal of components (for example, a dispersant) other than the toner cores 3 from the aqueous dispersion.

In order to favorably form the shell layers 4 on the surfaces of the toner cores 3, the toner cores 3 preferably have a negative triboelectric charge (less than 0 μC/g), and more preferably a triboelectric charge of no greater than −10 μC/g. In order to measure the triboelectric charge of the toner cores 3, 100 parts by mass of a standard carrier and 7 parts by mass of the toner cores 3 are mixed using a TURBULA (registered Japanese trademark) Mixer for 30 minutes.

<5-2. Step of Forming Shell Layers>

In the step of forming the shell layers 4, the toner cores 3 are coated by a shell material. Formation of the shell layers 4 is preferably performed in an aqueous medium in order to inhibit elution of components (for example, the binder resin or the releasing agent) contained in the toner cores 3. In order to coat the toner cores 3, for example, the shell material in the aqueous medium is supplied to the toner cores 3. According to this coating method, the shell layers 4 are easily formed on the surfaces of the toner cores 3, which are in a solid state and in a powder state. Examples of the coating method include an in-situ polymerization process, an in-liquid curing coating process, and a coacervation process. The in-situ polymerization is particularly preferable in terms of achieving high reactivity of the toner cores 3 and the shell layers 4 with one another. According to the in-situ polymerization process, the shell material is present only in the aqueous medium, and the shell material resinifies through a reaction thereof on the surfaces of the toner cores 3 to form the shell layers 4.

The aqueous medium is preferably a solvent in which the shell material (for example, methylol melamine) is soluble. Examples of such solvents include a polar solvent. More specific examples thereof include water, methanol, and ethanol.

First, the shell material (for example, methylol melamine) is dissolved (or dispersed) in the aqueous medium. Next, the toner cores 3 are dispersed in the aqueous medium containing the shell material dissolved (or dispersed) therein. In order to uniformly coat the toner cores 3 with the shell material, the toner cores 3 are preferably dispersed to a high degree in the aqueous medium.

In order to disperse the toner cores 3 in the aqueous medium to a high degree, the toner cores 3 may be mechanically dispersed using a device capable of vigorous stirring of the aqueous medium (for example, "HIVIS MIX", product of PRIMIX Corporation).

Alternatively or additionally, in order to disperse the toner cores 3 in the aqueous medium to a high degree, the aqueous medium may contain a dispersant. Examples of dispersants that can be used include sodium polyacrylate, polyparavinyl phenol, partially saponified polyvinyl acetate, isoprene sulfonic acid, polyethers, isobutylene-maleic anhydride copolymer, sodium polyaspartate, starch, gum arabic, polyvinylpyrrolidone, and sodium ligninesulfonate. One of the dispersants listed above may be used independently, or two or more of the dispersants may be used in combination. Preferably, the amount of the dispersant is for example no greater than 75 parts by mass relative to 100 parts by mass of the toner cores 3.

The temperature of the aqueous medium used for formation of the shell layers 4 is preferably no less than 40° C. and no greater than 80° C., and more preferably no less than 55° C. and no greater than 80° C. As a result of the temperature of the aqueous medium being within the aforementioned range, formation of the shell layers 4 on the surfaces of the toner cores 3 proceeds favorably.

The average surface roughness (Rz) of the toner mother particles 2 is adjusted by changing the temperature of the aqueous medium and the reaction time for formation of the shell layers 4. For example, a temperature of the aqueous medium of 70° C. and a reaction time of no less than 1.5 hours and less than 3 hours tend to yield toner mother particles 2 having an average surface roughness of no less than 50 nm and no greater than 150 nm. In order to obtain toner mother particles 2 having an average surface roughness of no less than 50 nm and no greater than 150 nm, it is preferable that the temperature of the aqueous medium is 70° C. and the reaction time is 2 hours. For example, a temperature of the aqueous medium of 70° C. and a reaction time of no less than 3 hours tend to yield toner mother particles 2 having an average surface roughness of less than 50 nm. For another example, a temperature of the aqueous medium of 75° C. and a reaction time of no less than 1 hour also tend to yield toner mother particles 2 having an average surface roughness of less than 50 nm. For another example, a temperature of the aqueous medium of 65° C. and a reaction time of no greater than 1 hour tend to yield toner mother particles 2 having an average surface roughness of greater than 150 nm.

After the shell material is dissolved (or dispersed) in the aqueous medium, the aqueous medium is preferably adjusted to approximately pH 4 using an acidic substance prior to addition of the toner cores 3. Adjusting the aqueous medium to an acidic pH promotes a polycondensation reaction of the shell material contained in the aqueous medium.

After the pH of the aqueous medium is adjusted as necessary, the toner cores 3 are added to the aqueous medium containing the shell material. Thereafter, the aqueous medium is for example heated to allow a reaction between the surfaces of the toner cores 3 and the shell material to proceed in the aqueous medium. Through the above, the surfaces of the toner cores 3 are coated by the shell layers 4. The aqueous medium containing the toner cores 3 coated by the shell layers 4 is cooled to room temperature to give a dispersion of the toner mother particles 2.

<5-3. Washing Step>

In the washing step, the toner mother particles 2 are washed with water. An example of a washing method is a method involving collecting a wet cake of the toner mother particles 2 from the dispersion of the toner mother particles 2 by solid-liquid separation and washing the collected wet cake of the toner mother particles 2 using water. Preferably, a filtrate obtained through the solid-liquid separation has an electrical conductivity of no greater than 10 μS/cm. The electrical conductivity can for example be measured using an electrical conductivity meter "Horiba COND METER ES-51", product of HORIBA, Ltd. Another example of the washing method is a method involving causing sedimentation of the toner mother particles 2 in the dispersion, exchanging a supernatant with water, and subsequently re-dispersing the toner mother particles 2 in the water.

<5-4. Drying Step>

In the drying step, the toner mother particles 2 are dried. An example of a method for drying the toner mother particles 2 involves using a dryer (for example, a spray dryer, a fluidized bed dryer, a vacuum freeze dryer, or a reduced pressure dryer). In particular, the spray dryer is preferable in terms that use of the spray dryer inhibits aggregation of the toner mother particles 2 during drying. The spray dryer can be used to perform either or both of the first external additive addition step and the second external additive addition step, which are described later, at the same time as the drying step. More specifically, either or both of a dispersion of the first inorganic oxide particles 5 and a dispersion of the second inorganic oxide particles 6 is sprayed together with the dispersion of the toner mother particles 2. As a result, either or both of the first inorganic oxide particles 5 and the second inorganic oxide particles 6 can be caused to adhere to the surfaces of the toner mother particles 2.

<5-5. First External Additive Addition Step>

In the first external additive addition step, the second inorganic oxide particles 6 are caused to adhere to the surfaces of the toner mother particles 2. For example, the second inorganic oxide particles 6 are caused to adhere to the surfaces of the toner mother particles 2 by a method involving mixing the toner mother particles 2 with the second inorganic oxide particles 6 using a mixer (for example, an FM mixer or a Nauta mixer (registered Japanese trademark) under conditions that ensure that the second inorganic oxide particles 6 do not become embedded in the surfaces of the toner mother particles 2. In a configuration in which the toner particles 1 do not have the second inorganic oxide particles 6, the first external additive addition step is omitted.

<5-6. Second External Additive Addition Step>

In the second external additive addition step, the first inorganic oxide particles 5 are caused to adhere to the surfaces of the toner mother particles 2 having the second inorganic oxide particles 6 adhering thereto. For example, the first inorganic oxide particles 5 are caused to adhere to the surfaces of the toner mother particles 2 by a method involving mixing the toner mother particles 2 having the second inorganic oxide particles 6 adhering thereto with the first inorganic oxide particles 5 using a mixer (for example, an FM mixer or a Nauta mixer (registered Japanese trademark)) under conditions that ensure that the first inorganic oxide particles 5 do not become embedded in the surfaces of the toner mother particles 2.

The method for producing the toner may be altered as appropriate in accordance with requirements of the toner, such as in terms of composition and properties. For example, addition of the toner cores 3 to the aqueous medium may alternatively be performed before dissolution or dispersion of the shell material in the aqueous medium. Note that non-essential steps may alternatively be omitted. Preferably, a large number of the toner particles 1 are formed at the same time in order that the toner can be produced efficiently.

The toner according to the present embodiment has been described above with reference to FIGS. 1A to 6. According to the toner of the present embodiment, it is possible to improve ease of toner cleaning and thus restrict occurrence of an image defect. Furthermore, according to the toner of the present embodiment, it is possible to improve fluidity of the toner. The toner of the present embodiment can therefore be favorably used in various image forming apparatuses.

EXAMPLES

The following provides more specific description of the present disclosure through use of Examples. The present disclosure is not limited to the scope of the Examples.

<1. Measurement Methods>

First, methods for measuring physical properties that are employed in the Examples will be described.

<1-1. Average Major Axis Diameter, Average Minor Axis Diameter, and Aspect Ratio>

First inorganic oxide particles in a sample (toner) were observed at a magnification of ×50,000 and images of 100 first inorganic oxide particles randomly selected therefrom were captured using a scanning electron microscope ("JSM-7500F", product of JEOL Ltd.). Next, the captured images were analyzed using image analysis software to measure a major axis diameter and a minor axis diameter of each of the 100 first inorganic oxide particles. Next, a sum of all the major axis diameters measured was divided by the number (100) of first inorganic oxide particles measured. Likewise, a sum of all the minor axis diameters measured was divided by the number (100) of first inorganic oxide particles measured. Thus, an average major axis diameter (arithmetic mean value) and an average minor axis diameter (arithmetic mean value) of the first inorganic oxide particles were calculated. An aspect ratio (average major axis diameter/average minor axis diameter) of the first inorganic oxide particles was calculated by dividing the average major axis diameter by the average minor axis diameter.

<1-2. Average Roundness>

An average roundness of toner mother particles was measured using a flow particle imaging analyzer ("FPIA (registered Japanese trademark) 3000", product of Malvern Instruments Ltd.). More specifically, a roundness was measured for each of 100 toner mother particles. Next, a sum of all the roundnesses measured was divided by the number (100) of toner mother particles measured. Thus, an average roundness (arithmetic mean value) of the toner mother particles was calculated.

<1-3. Average Surface Roughness (Rz)>

An average surface roughness (Rz) of toner mother particles was measured using a scanning probe microscope (SPM) ("multifunctional unit AFM5200S", former product name: SII S-image, product of Hitachi High-Tech Science Corporation) under the following conditions. More specifically, a surface roughness (Rz) was measured for each of 20 toner mother particles. Next, a sum of all the surface roughnesses (Rz) measured was divided by the number (20) of toner mother particles measured. Thus, an average surface roughness (Rz) (arithmetic mean value) of the toner mother particles was calculated.

(Conditions for Measurement of Average Surface Roughness)

Scanner: 100 μm (Small Unit)

Measurement mode: SIS-DFM (resonant mode), topographic image

Cantilever: OMCL-AC-240TS-C3 (product of Olympus Corporation)

Resolutions: X data number 256, Y data number 256

Measurement range: 1 μm×1 μm of toner mother particle surface

<1-4. Volume Median Diameter ($D_{50}$)>

The volume median diameter ($D_{50}$) was measured using a precision particle size distribution analyzer ("Coulter Counter Multisizer 3", product of Beckman Coulter, Inc.).

<2. Preparation of Tone (A-1)>

Next, a toner (A-1) was prepared according to the following method.

<2-1. Toner Core Formation>

A binder resin, a releasing agent, a colorant, and a charge control agent shown in Table 1 were used for preparation of toner cores. First, 100 parts by mass of the binder resin, 5 parts by mass of the releasing agent, 5 parts by mass of the colorant, and 1 part by mass of the charge control agent were mixed at a rate of 2,400 rpm using an FM mixer (product of Nippon Coke & Engineering Co., Ltd.). Next, the resultant mixture was melt-kneaded using a two screw extruder ("PCM-30", product of Ikegai Corp.) under conditions of a material loading rate of 5 kg/hour, a screw rotation speed of 160 rpm, and a temperature setting range of from 80° C. to 130° C. The resultant melt-knead was rolled and cooled. The rolled and cooled melt-knead was coarsely pulverized using a pulverizer ("Rotoplex (registered Japanese trademark) 16/8, product of Hosokawa Micron Corporation). Next, the coarsely pulverized product was finely pulverized using a jet mill ("Model-I Super Sonic Jet Mill", product of Nippon Pneumatic Mfg.). The finely pulverized product was classified using an Elbow Jet ("EJ-LABO", product of Nittetsu Mining Co., Ltd.). As a result, toner cores were obtained. The toner cores thus obtained had a volume median diameter ($D_{50}$) of 6.5 μm.

TABLE 1

| | Type |
|---|---|
| Binder resin | Polyester resin ("TUFTONE (registered Japanese trademark) NE-410", product of Kao Corporation) |
| Releasing agent | Polypropylene wax ("VISCOL (registered Japanese trademark) 660P", product of Sanyo Chemical Industries, Ltd.) |
| Colorant | Carbon black ("REGAL (registered Japanese trademark) 330R", product of Cabot Corporation) |
| Charge control agent | "BONTRON (registered Japanese trademark) N-71", product of ORIENT CHEMICAL INDUSTRIES, Co., Ltd. |

<2-2. Shell Layer Formation>

A three-necked flask having a capacity of 1 L was set up in a water bath ("IWB-250", product of AS ONE Corporation) at 30° C. and 300 mL of ion exchanged water was added into the flask. Next, hydrochloric acid was added into the flask to adjust the flask contents to pH 4.

Next, 2 mL of methylol melamine ("Nikaresin (registered Japanese trademark) S-260", product of Nippon Carbide Industries Co., Inc.) was added into the flask as a shell material. Next, the methylol melamine was dissolved in the ion exchanged water in the flask to give a solution of the shell material.

Next, 300 g of the toner cores were added to the solution of the shell material and the flask contents were sufficiently stirred. Furthermore, 500 mL of ion exchanged water was added into the flask, and the temperature of the flask contents was increased to 70° C. under stirring. Thereafter, the flask contents were stirred at 70° C. for 2 hours. Next, an aqueous sodium hydroxide solution was added into the flask to neutralize the flask contents to pH 7. As a result, shell layers were formed over surfaces of the toner cores to give a toner mother particle-containing dispersion.

Next, a wet cake of the toner mother particles was collected from the toner mother particle-containing dispersion through filtration using a Buchner funnel. The wet cake of the toner mother particles was dispersed in ion exchanged water to wash the toner mother particles. Washing of the toner mother particles with ion exchanged water was repeated in the same manner five times. After washing, the wet cake of the toner mother particles was dried to give dried toner mother particles. The resultant toner mother particles had a surface roughness (Rz) of 90 nm.

<2-4. First External Additive Addition Step>

An FM mixer ("FM-10B", product of Nippon Coke & Engineering Co., Ltd.) was used to mix 100 parts by mass of the dried toner mother particles, 1.0 parts by mass of conductive titanium oxide fine particles ("EC-100", product of Titan Kogyo, Ltd., volume median diameter ($D_{50}$): 0.36±0.04 μm), and 0.7 parts by mass of hydrophobic silica fine particles ("RA-200H", product of Nippon Aerosil Co., Ltd., volume median diameter ($D_{50}$): 20 nm) at a rotation speed of 3,500 rpm for 5 minutes. Through mixing, the conductive titanium oxide fine particles and the hydrophobic silica fine particles were caused to adhere to surfaces of the toner mother particles.

<2-5. Second External Additive Addition Step>

First, 1.0 part by mass (1.0% by mass relative to mass of the toner mother particles) of first inorganic oxide particles A were added to and mixed with the toner mother particles obtained through the first external additive addition step using an FM mixer ("FM-10B", product of Nippon Coke & Engineering Co., Ltd.) at a rotation speed of 3,500 rpm for 5 minutes. Next, the resultant mixture was sifted using a 200 mesh sieve (opening: 75 μm) to yield a toner (A-1). Table 2 shows details of the first inorganic oxide particles A used in the preparation of the toner (A-1).

<3. Preparation of Toners (A-2) to (A-4) and (B-1) to (B-10)>

Toners (A-2) to (A-4) and (B-1) to (B-10) were prepared in the same manner as in the preparation of the toner (A-1) except the following changes.

The temperature of the aqueous medium (equivalent to the temperature of the flask contents) and the reaction time (equivalent to the stirring time) in the shell layer formation were changed from 70° C. and 2 hours employed in the preparation of the toner (A-1) to the following temperature and reaction time. Thus, the average surface roughness (Rz) of the toner mother particles was changed to the values shown in Table 3. In the preparation of each of the toners (A-2) to (A-4), the temperature of the aqueous medium was 70° C., and the reaction time was no less than 1.5 hours and less than 3 hours. Furthermore, the shell layer formation reaction was stopped when the average surface roughness (Rz) of the toner mother particles reached each value shown in Table 3. In the preparation of each of the toners (B-1) to (B-4) and (B-9), the temperature of the aqueous medium was 70° C., and the reaction time was no less than 3 hours. Furthermore, the shell layer formation reaction was stopped when the average surface roughness (Rz) of the toner mother particles reached each value shown in Table 3. In the preparation of each of the toners (B-5) to (B-8) and (B-10), the temperature of the aqueous medium was 65° C., and the reaction time was no greater than 1 hour. Furthermore, the shell layer formation reaction was stopped when the average surface roughness (Rz) of the toner mother particles reached each value shown in Table 3.

The type and the amount of the first inorganic oxide particles were changed from the first inorganic oxide particles A and 1.0 part by mass (1.0% by mass relative to mass of the toner mother particles) employed in the preparation of the toner (A-1) to the type and amount shown in Table 3. Table 2 shows details of the first inorganic oxide particles A, B, C, and D used in the preparation of the toners.

<4. Fluidity Evaluation>

An apparent density (AD) of each of the toners prepared as described above was measured in accordance with Japanese Industrial Standard (JIS) K5101-12-1.

Based on the apparent density, fluidity of each toner was evaluated in accordance with the following standard. Table 3 shows the apparent density and results of the fluidity evaluation of the toners. A higher apparent density indicates that the toner has higher fluidity.

(Fluidity Evaluation Standard)

G (Good): An apparent density of greater than 0.390 g/cm$^3$

M (Mediocre): An apparent density of greater than 0.370 g/cm$^3$ and no greater than 0.390 g/cm$^3$ P (Poor): An apparent density of no greater than 0.370 g/cm$^3$ <5. Preparation of Two-Component Developer>

A two-component developer was prepared using each of the toners. More specifically, 10 parts by mass of each toner was mixed with 90 parts by mass of a ferrite carrier to give a two-component developer. The ferrite carrier used for the preparation of the two-component developer was prepared as described below.

Manganese-magnesium (Mn—Mg) ferrite cores having a volume median diameter ($D_{50}$) of 35 μm were used as the carrier cores. A solution of 30 parts by mass of a silicone resin in 200 parts by mass of toluene was used as an application liquid for the carrier cores. After 230 parts by mass of the application liquid was applied to 1,000 parts by mass of the ferrite cores by spraying, a heat treatment was performed at 200° C. for 60 minutes. Thus, a ferrite carrier was obtained.

<6. Ease of Toner Cleaning Evaluation>

An image was formed on paper using each of the two-component developers prepared as described above and an evaluation apparatus. Ease of toner cleaning was evaluated based on the image obtained. A color multifunction peripheral ("TASKalfa 5550ci", product of KYOCERA Document Solutions Inc.) was used as the evaluation apparatus. Image formation was performed under the following conditions.

(Image Formation Conditions)

Charging: scorotron charging

Light exposure: Laser exposure

Development: touchdown development

Transfer: Intermediate transfer belt transfer process, roller transfer process

Cleaning: Blade-using cleaning

Photosensitive member: Amorphous silicon drum (diameter: 30 mm)

Photosensitive member linear velocity: 300 mm/second

Photosensitive member surface potential: 200 V

Development roller material: Urethane

Development roller diameter: 20 mm

Development roller peripheral speed: 500 mm/second

TABLE 2

| Type of first inorganic oxide particles | Average major axis diameter [nm] | Average minor axis diameter [nm] | Aspect ratio | Raw material | Product name | Manufacturer |
|---|---|---|---|---|---|---|
| A | 1680 | 130 | 12.9 | Titanium oxide | FTL-100 | ISHIHARA SANGYO KAISHA, LTD. |
| B | 2860 | 210 | 13.6 | | FTL-200 | |
| C | 5150 | 270 | 19.1 | | FTL-300 | |
| D | 120 | 20 | 6.0 | | ST-455 | Titan Kogyo, Ltd. |

Development bias: 300 V

Gap width between photosensitive member and development roller: 150 μm

Primary transfer bias: 2 kV

Nip width between photosensitive member and transfer roller: 2 mm

Cleaning blade contact angle: 20°

With respect to each of the two-component developers, the two-component developer was added into a black-color developing device in the evaluation apparatus. With respect to each of the toners, the toner was added into a black-color toner container in the evaluation apparatus. Next, an image was printed on 10,000 successive sheets of paper with a coverage of 5% in a standard temperature and humidity environment (23° C., 50% RH). Next, the coverage was changed from 5% to 40%, and an image was printed on 10,000 successive sheets of paper in a standard temperature and humidity environment (23° C., 50% RH). Next, the coverage was changed from 40% to 0.2%, and an image was printed on 10,000 successive sheets of paper in a standard temperature and humidity environment (23° C., 50% RH). The images printed on the lastly printed sheets ($10{,}000^{th}$ sheets) in printing with a coverage of 5%, printing with a coverage of 40%, and printing with a coverage of 0.2% were used as evaluation images. Presence or absence of an image defect on the evaluation images was observed with unaided eyes. Based on an observation result, ease of toner cleaning was evaluated in accordance with the following standard. Table 3 shows results of the ease of toner cleaning evaluation. The more insufficient toner cleaning on the photosensitive member by the cleaning blade, the more likely a resulting image is to have an image defect (for example, a longitudinal line).

(Standard for Ease of Toner Cleaning Evaluation)

G (Good): No longitudinal line due to insufficient cleaning observed in image in printing with a coverage of 5%, printing with a coverage of 40%, and printing with a coverage of 0.2%

M (Mediocre): Longitudinal line due to insufficient cleaning slightly observed in image in any of printing with a coverage of 5%, printing with a coverage of 40%, and printing with a coverage of 0.2%

P (Poor): Longitudinal line due to insufficient cleaning clearly observed in image in any of printing with a coverage of 5%, printing with a coverage of 40%, and printing with a coverage of 0.2%

<7. Detachment Ratio Measurement>

With respect to each of the toners, a surface of a toner particle in the toner was observed and a photograph thereof was taken using a scanning electron microscope ("JSM-7500F", product of JEOL Ltd.). The number (P1) of first inorganic oxide particles per unit area among the first inorganic oxide particles present on the surface of the toner mother particle was determined on the thus obtained photograph.

Next, using the two-component developer including the toner, an image was printed on 10,000 successive sheets of paper with a coverage of 5% in a standard temperature and humidity environment (23° C., 50% RH) in the same manner as in the ease of toner cleaning evaluation. After completion of printing, the two-component developer was taken out of the developing device. A surface of a toner particle included in the taken-out two-component developer was observed and a photograph thereof was taken using a scanning electron microscope ("JSM-7500F", product of JEOL Ltd.). The number (P2) of first inorganic oxide particles per unit area among the first inorganic oxide particles present on the surface of the toner mother particle was determined on the thus obtained photograph.

Based on the thus determined P1 and P2, a detachment ratio was calculated in accordance with the formula 1 shown below. Table 3 shows the thus calculated detachment ratio.

$$\text{Detachment ratio[\% by number]}=100\times(P1-2)/P1 \quad (1)$$

In Table 3, "Rz" represents the surface roughness of the toner mother particles, and "AD" represents the apparent density of the toner.

TABLE 3

| | First inorganic oxide particles | | Toner mother particles | | | Ease of toner | Fluidity | |
|---|---|---|---|---|---|---|---|---|
| Toner | Type | Amount [wt %] | Average roundness | Average Rz [nm] | Detachment ratio [% by number] | cleaning Evaluation | AD [g/cm$^3$] | Evaluation |
| A-1 | A | 1.0 | 0.965 | 90 | 70 | G | 0.405 | G |
| A-2 | A | 1.5 | 0.964 | 88 | 76 | G | 0.401 | G |
| A-3 | A | 2.0 | 0.965 | 95 | 83 | G | 0.398 | G |
| A-4 | B | 1.5 | 0.963 | 102 | 85 | G | 0.393 | G |
| B-1 | A | 0.8 | 0.972 | 40 | 68 | P | 0.380 | M |
| B-2 | C | 1.5 | 0.970 | 45 | 91 | M | 0.367 | P |
| B-3 | D | 1.5 | 0.974 | 38 | 93 | P | 0.385 | M |
| B-4 | None | None | 0.972 | 42 | 0 | P | 0.395 | G |
| B-5 | A | 0.8 | 0.950 | 170 | 28 | M | 0.369 | P |
| B-6 | C | 1.5 | 0.952 | 179 | 45 | M | 0.365 | P |
| B-7 | D | 1.5 | 0.954 | 168 | 68 | P | 0.368 | P |
| B-8 | None | None | 0.950 | 172 | 0 | P | 0.380 | M |
| B-9 | A | 2.3 | 0.965 | 18 | 88 | G | 0.364 | P |
| B-10 | A | 1.5 | 0.948 | 172 | 41 | M | 0.360 | P |

As shown in Table 3, the toners (A-1) to (A-4) were superior in terms of ease of toner cleaning. Consequently, occurrence of an image defect resulting from insufficient cleaning was restricted in images formed using the toners (A-1) to (A-4). Furthermore, the toners (A-1) to (A-4) were also superior in terms of fluidity.

The toners (B-1) and (B-5) contained less than 1.0% by mass of first inorganic oxide particles. Furthermore, the toner mother particles in the toner (B-5) had an average roundness of less than 0.960. The first inorganic oxide particles in the toners (B-2) and (B-6) had an average major axis diameter of greater than 3,000 nm and an average minor axis diameter of greater than 250 nm. The first inorganic oxide particles in the toners (B-3) and (B-7) had an average major axis diameter of less than 500 nm and an average minor axis diameter of less than 100 nm. The toners (B-1) to (B-3) and (B-5) to (B-7) were therefore inferior in terms of ease of toner cleaning. Consequently, an image defect resulting from insufficient cleaning occurred in images formed using the toners (B-1) to (B-3) and (B-5) to (B-7). Furthermore, the toners (B-1) to (B-3) and (B-5) to (B-7) were also inferior in terms of fluidity.

The toners (B-4) and (B-8) contained no first inorganic oxide particles. The toners (B-4) and (B-8) were therefore inferior in terms of ease of toner cleaning. Consequently, an image defect resulting from insufficient cleaning occurred in images formed using the toners (B-4) and (B-8).

The toner (B-9) contained greater than 2.0% by mass of first inorganic oxide particles relative to mass of the toner mother particles. The toner (B-9) was therefore inferior in terms of fluidity.

The toner mother particles in the toner (B-10) had an average roundness of less than 0.960. The toner (B-10) was therefore inferior in terms of ease of toner cleaning. Consequently, an image defect resulting from insufficient cleaning occurred in an image formed using the toner (B-10). The toner (B-10) was also inferior in terms of fluidity.

What is claimed is:

1. An electrostatic latent image developing toner comprising a plurality of toner particles, wherein the toner particles each have a toner mother particle and first inorganic oxide particles disposed on a surface of the toner mother particle, the first inorganic oxide particles are contained in the electrostatic latent image developing toner in an amount of no less than 1.0% by mass and no greater than 2.0% by mass relative to mass of the toner mother particles, the toner mother particles have an average roundness of no less than 0.960, the first inorganic oxide particles have an average major axis diameter of no less than 500 nm and no greater than 3,000 nm, an average minor axis diameter of no less than 100 nm and no greater than 250 nm, and an aspect ratio of no less than 2 and no greater than 20, and the first inorganic oxide particles have a detachment ratio of no less than 50% by number and no greater than 90% by number.

2. The electrostatic latent image developing toner according to claim 1, wherein the toner mother particles have an average surface roughness of no less than 50 nm and no greater than 150 nm.

3. The electrostatic latent image developing toner according to claim 1, wherein the toner particles further have second inorganic oxide particles, the second inorganic oxide particles are disposed so as to cover a surface of each of the toner mother particles, the first inorganic oxide particles are disposed on the surface of each of the toner mother particles on which the second inorganic oxide particles are disposed, and the second inorganic oxide particles have a volume median diameter of no greater than 50 nm.

4. The electrostatic latent image developing toner according to claim 1, wherein the toner mother particles each have a toner core and a shell layer covering the toner core.

5. The electrostatic latent image developing toner according to claim 1, wherein the toner mother particles have an average surface roughness of no less than 85 nm and no greater than 105 nm, and the first inorganic oxide particles have a detachment ratio of no less than 70% by number and no greater than 85% by number.

6. The electrostatic latent image developing toner according to claim 1, wherein the detachment ratio is a ratio of the number of first inorganic oxide particles, among the first inorganic oxide particles, that detach from the toner mother particles to land on a surface of a photosensitive member after a development section supplies the toner particles to the surface of the photosensitive member and before the toner particles on the surface of the photosensitive member reach a cleaning section, relative to a total number of the first inorganic oxide particles.

7. The electrostatic latent image developing toner according to claim 5, wherein the detachment ratio is a ratio of the number of first inorganic oxide particles, among the first inorganic oxide particles, that detach from the toner mother particles to land on a surface of a photosensitive member after a development section supplies the toner particles to the surface of the photosensitive member and before the toner particles on the surface of the photosensitive member reach a cleaning section, relative to a total number of the first inorganic oxide particles.

* * * * *